US006933444B2

(12) United States Patent
Albert et al.

(10) Patent No.: US 6,933,444 B2
(45) Date of Patent: Aug. 23, 2005

(54) CONDUCTOR RAIL SYSTEM WITH CONTROL LINE

(75) Inventors: Dieter Albert, Berlin (DE); Udo Bansbach, Berlin (DE); Thomas Knoop, Berlin (DE)

(73) Assignee: Semperlux AG, Lichttechnische Werke, Berlin (DE)

( * ) Notice: Subject to any disclaimer, the term of this patent is extended or adjusted under 35 U.S.C. 154(b) by 106 days.

(21) Appl. No.: 10/390,007

(22) Filed: Mar. 18, 2003

(65) Prior Publication Data

US 2003/0179578 A1 Sep. 25, 2003

(30) Foreign Application Priority Data

Mar. 19, 2002 (DE) ..... 102 12 232

(51) Int. Cl.[7] ..... H01B 5/03

(52) U.S. Cl. ..... 174/68.1; 174/96; 340/568.2; 340/687; 315/76

(58) Field of Search ..... 340/825.69, 691.8, 340/568.2, 619, 687; 700/9; 702/188; 708/140; 174/68.1, 96; 315/76

(56) References Cited

U.S. PATENT DOCUMENTS

| | | | | | |
|---|---|---|---|---|---|
| 4,796,018 | A | | 1/1989 | Nakanishi et al. | 340/691.1 |
| 5,241,380 | A | | 8/1993 | Benson et al. | 348/143 |
| 5,336,849 | A | * | 8/1994 | Whitney | 174/48 |
| 5,839,097 | A | * | 11/1998 | Klausner | 340/825.69 |
| 5,869,786 | A | * | 2/1999 | Jaakkola et al. | 174/96 |
| 6,686,841 | B1 | * | 2/2004 | Busch et al. | 340/571 |

FOREIGN PATENT DOCUMENTS

| | | | |
|---|---|---|---|
| CA | 2294874 | | 1/1999 |
| DE | 38 12 465 | C2 | 10/1989 |
| DE | 40 20 807 | A1 | 6/1990 |
| DE | 42 41 862 | C2 | 6/1994 |
| DE | 100 18 073 | A1 | 4/2000 |
| DE | 299 17 691 | U1 | 4/2000 |
| GB | 2 215 105 | A | 9/1989 |
| JP | 2001 273 814 | | 10/2001 |

OTHER PUBLICATIONS

Publication DALI.
Publication Neue digitale Lichtsysteme.

* cited by examiner

*Primary Examiner*—Haissa Philogene
(74) *Attorney, Agent, or Firm*—Lawrence G. Fridman

(57) ABSTRACT

The invention relates to an electrical supply and control system for supplying electrical energy to an electrical device arrangement, which includes at least one sensor means, and for remote-controlling said electrical device arrangement. In order to provide an inexpensive conductor rail system, which permits the control of connected electrical devices depending on an environmental situation, the invention provides at least one profiled conductor rail with a power conductor and control lines extending along the conductor rail. Adapters are provided for releasably attaching at least on electrical device of the electrical device arrangement to the conductor rail and for, thereby, electrically connecting the power conductor and the control lines to the device. A central control computer is connected to the control lines for receiving, through the control lines, signals from the electrical device arrangement and for transmitting, through the control lines, control signals for controlling at least one electrical device of the electrical device arrangement. The sensor or sensors transmit sensor signals exclusively to said central control computer. The electrical device arrangement is controlled exclusively by the central control means, each electrical device of said electrical device arrangement being individually addressable by the central control computer.

10 Claims, 17 Drawing Sheets

CONDUCTOR RAIL SYSTEM WITH CONTROL LINE

FIELD OF INVENTION

The invention relates to an electrical supply and control system for supplying electrical energy to an electrical device arrangement, which includes at least one sensor means, and for remote-controlling said electrical device arrangement.

BACKGROUND OF THE INVENTION

Often, lamps with adjustable parameters are used for the illumination of buildings. These adjustable parameters include the selection of lamps which are to be switched on and the desired brightness of the lamps. Usually the lamps can be controlled by a switch near a door for switching the lamp on or off. The switch can be equipped with a dimmer for varying the brightness of the lamps.

Conductor rail systems are known, which permit positioning of lamps at any location along a conductor rail. The conductor rail consists of a U-profile, which can be mounted in or on the ceiling of a room. Insulated conductors paths are provided along the conductor rail on the inside of the U-profile. Each lamp has an adapter for attaching the lamp to the conductor rail system. The adapter has built-in contact pads to provide electrical connection to the electrical conductors of the conductor rail. The advantage of such conductor rail systems is, that the lamp can easily be mounted at a desired position even by a person having no or little professional skill. A further advantage of the conductor rail systems is, that they can be pre-installed in new buildings, even if the use, the number, type and position of the lamps is still not determined. Conventional conductor rail systems of this type do not permit individual control of lamps. Therefore additional means have to be used to provide the lamps with information about the desired operational state.

To this end, it is known to transmit such information via radio frequency or infrared transmitters and receivers. Such transmission is interference prone. The transmission causes "electrical smog", which may disturb other devices. Also the use of specific transmitter and receiver systems is expensive. If the information is transmitted by infrared radiation, other systems in the room may be disturbed.

It is known to transmit information combined with a power supply through cables passing through cable ducts. Cable ducts are fixedly installed tubes or profiles made of plastics. In these cable duct, a multitude of electric wires, data cables and other cables can be loosely guided. Integrated junctions are provided in the plastic tubes. With a suitable interface the energy and information can be taken from these junctions. The junctions are located at fixed predefined locations in the cable duct. Installing additional junctions requires a skilled person and is expensive.

A system with a conductor rail and a data line is known under the name EIB (European Installation Bus). This system is described among others in the paper "Tageslichtabhängige Beleuchtungssysteme auf der Basis von Installationsbussen" by P. T. Knoop, Fortschritt-Ber. VDI Reihe 6 Nr. 396 1998. In this system, each lamp of an installation is connected with the conductor rail and the data line through a junction. The junction has a data processing unit. The junctions are provided together with an information generator and a translator in an actuator. The actuator is rigidly connected to the conductor rail. Each actuator of the system has equality of access regarding the communication of the connected devices. Each connected device is transmitter and receiver of information, which communicate through a bus-system. There is no central control unit. Therefore, the system is suitable for nearly unlimited large applications, like the management of complex systems in a building. But the system is too expensive for many simple applications.

DE 38 12 465 C2 discloses the combination of simple conductor rails with data lines for the illumination engineering. The system has a central control unit, which takes over the control of the system (master-slave-system). The lamps can be connected to the power conductor rail through a simple choke and an adapter. The control data can be communicated to the lamps through the data line. This permits central adjustment, for example, of the brightness of the lamps.

In the prior art conductor rail system with data line, the data flow in the form of control commands from the central control unit to the lamps connected to the conductor rail system. A change of the operational state can only be achieved by a program or by an input to the control unit.

DISCLOSURE OF THE INVENTION

It is an object of the invention to provide a conductor rail system, which permits the control of connected electrical devices depending on an environmental situation.

It is a further object of the invention to provide such a conductor rail system which is inexpensive as compared to similar systems of the prior art.

To this end, the invention provides an electrical supply and control system for supplying electrical energy to an electrical device arrangement, which includes at least one sensor means, and for remote-controlling said electrical device arrangement. There is at least one profiled conductor rail with power conductor means and control line means extending along said conductor rail. Means are provided for releasably attaching at least on electrical device of said electrical device arrangement to said conductor rail and for, thereby, electrically connecting said power conductor means and said control line means to said device. Central control means are connected to said control line means for receiving, through said control line means, signals from said electrical device arrangement and for transmitting, through said control line means, control signal for controlling at least one electrical device of said electrical device arrangement. Said sensor means transmit sensor signals exclusively to said central control means. Said electrical device arrangement is controlled exclusively by said central control means, each electrical device of said electrical device arrangement being individually addressable by said central control means.

This system is comparatively simple. There is only one central control means, which supplies control commands to the various electrical devices connected to the conductor rail system. The electrical devices do not communicate directly with each other. One of the electrical devices of the electrical device arrangement is a sensor. This sensor applies sensor signals to the electrical control means through the control line means. The central control line means respond to the sensor signals by supplying appropriate control commands through the control line means to appropriate electrical devices connected to the conductor rail system. The relation of the central control means and of the electrical devices is simply that of master and slave.

The electrical devices have no control function of their own. By the use of a common control means, normally in the form of a control computer, the individual electrical devices can be made inexpensive. The electrical devices do not require data processing units of their own.

The existing infrastructure for the power supply can be used for the data communication whereby high flexibility is provided. The installation of the devices including power supply and control at any location along the conductor rail system is easy and can be made even by persons of little skill. This makes the system of the invention particularly attractive in such cases, where the mode of use changes frequently and the devices have to be installed at varying locations.

A number of standards are suitable for the communication. A preferred communication standard is DALI (Digital Addressable Lighting Interface).

The system of the invention is particularly suitable for lamps as electrical devices. Also other devices like monitors, acoustic signaler transmitters, digital and analog recording- and playback devices for music, spoken text or other sound can be used. Each time, when the sensor provides an appropriate sensor signal, the electrical device will be put into operation, the operation will be stopped or changed. If one device is a monitor, video sequences or pictures can be made visible, if the sensor provides a certain signal.

The electrical device may be a display system, which provides an indication of direction depending on a particular sensor signal. Such a display system may be an illuminated or luminous arrow or also a display with different display patterns. Tis can be used to establish a person guiding system.

Furthermore, means for recording sensor signals or for recording information based on sensor signals can be provided. Then the system can be used for monitoring and analyzing events.

DESCRIPTION OF PREFERRED EMBODIMENTS

Figure 1A:
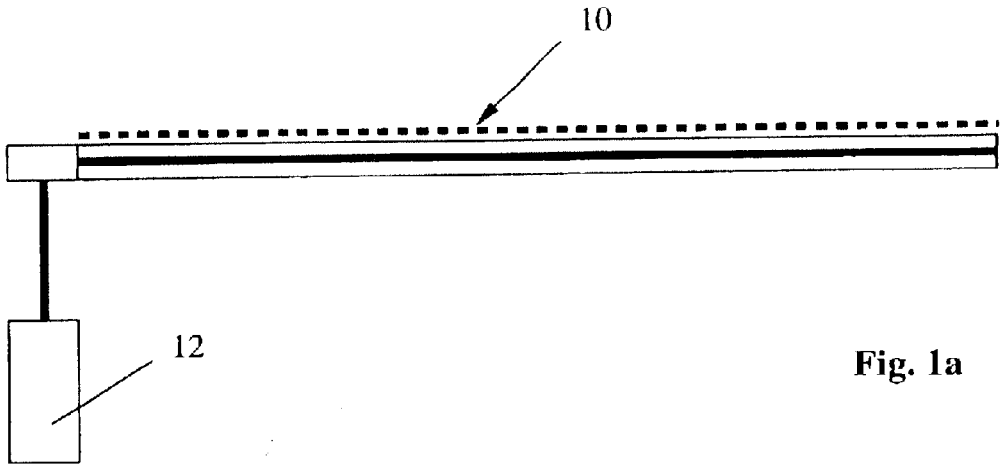
FIG. 1*a* schematically shows a conductor rail with a central control unit.
Figure 1B:
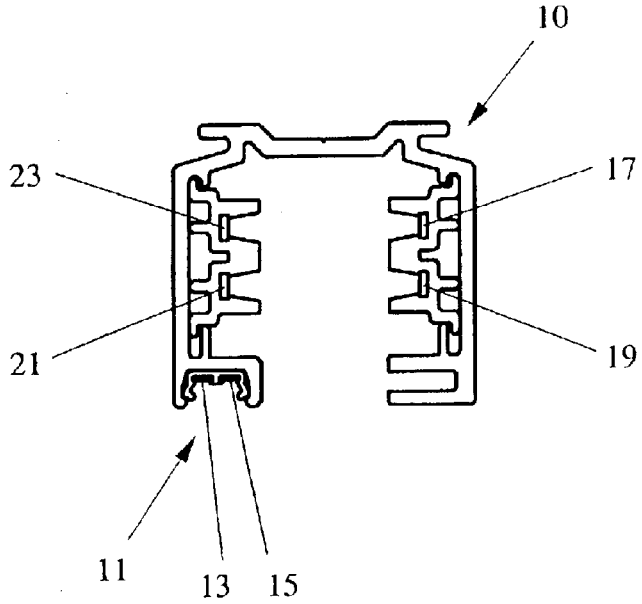
FIG. 1*b* is a cross sectional view of the conductor rail of FIG. 1*a*.

Referring to FIG. 1*a,* Numeral 10 designates part of a conductor rail, which is shown only schematically. Such a conductor rail is known. The conductor rail 10 is illustrated in cross section in FIG. 1*b*. The conductor rail 10 has essentially an inverted U-shaped cross section open at the bottom. In the U-shaped profile, various electrical devices can be mounted by means of an appropriate adapter, which is well known to a person skilled in the art and, therefore, is not illustrated. The contact with the power supply is established through cables 17, 19, 21 and 23. The conductor rails are known in principle, for example from the U.S. Pat. No. 5,869,786 and hence need not be described. In addition, the conductor rail 10 is equipped with a data line 11 consisting of two copper wires 13 and 15. The data can flow in both directions. Furthermore a control unit 12 is provided (FIG. 1*a*). The control unit or control computer 12 takes care of the control and the regulation of all devices connected to the conductor rail. The control unit 12 can also be attached to the conductor rail in any desired position by means of an adapter. The arrangement of FIG. 1 can operate without costly bus systems for data transmission and is hence comparatively inexpensive. Because on the limited number of electrical devices which can be installed therewith, it is suitable for rather small installations.

Figure 2:
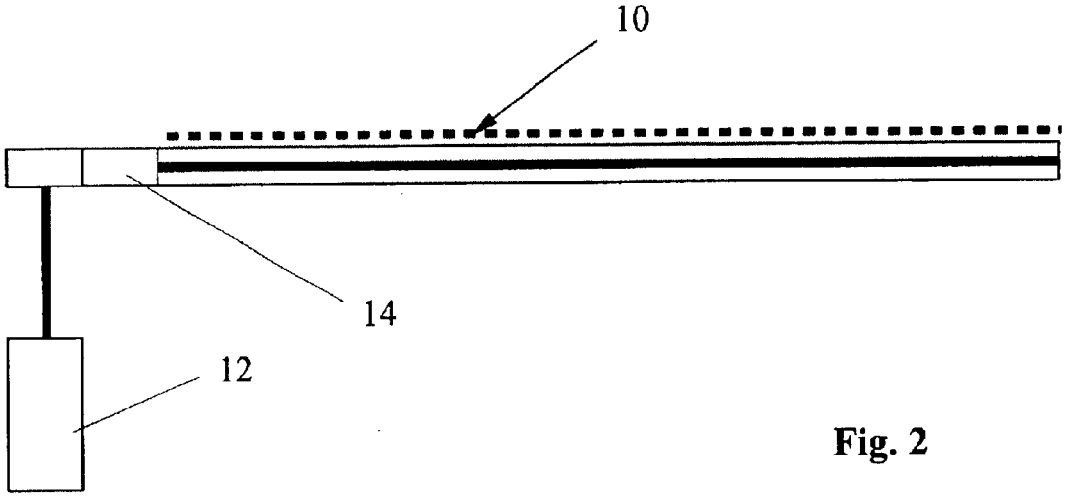
FIG. 2 schematically shows a conductor rail, which is connected to the data bus through a coupler.

In FIG. 2 a coupler 14 is provided between conductor 10 and the control unit 12. The coupler 14 permits data transfer from the conductor rail 10 to the bus system. Such bus-systems can be EIB or LON. Thus the field of application will be enlarged. The control unit 12 performs extensive functions on the basis of the complex bus systems.

Figure 3:
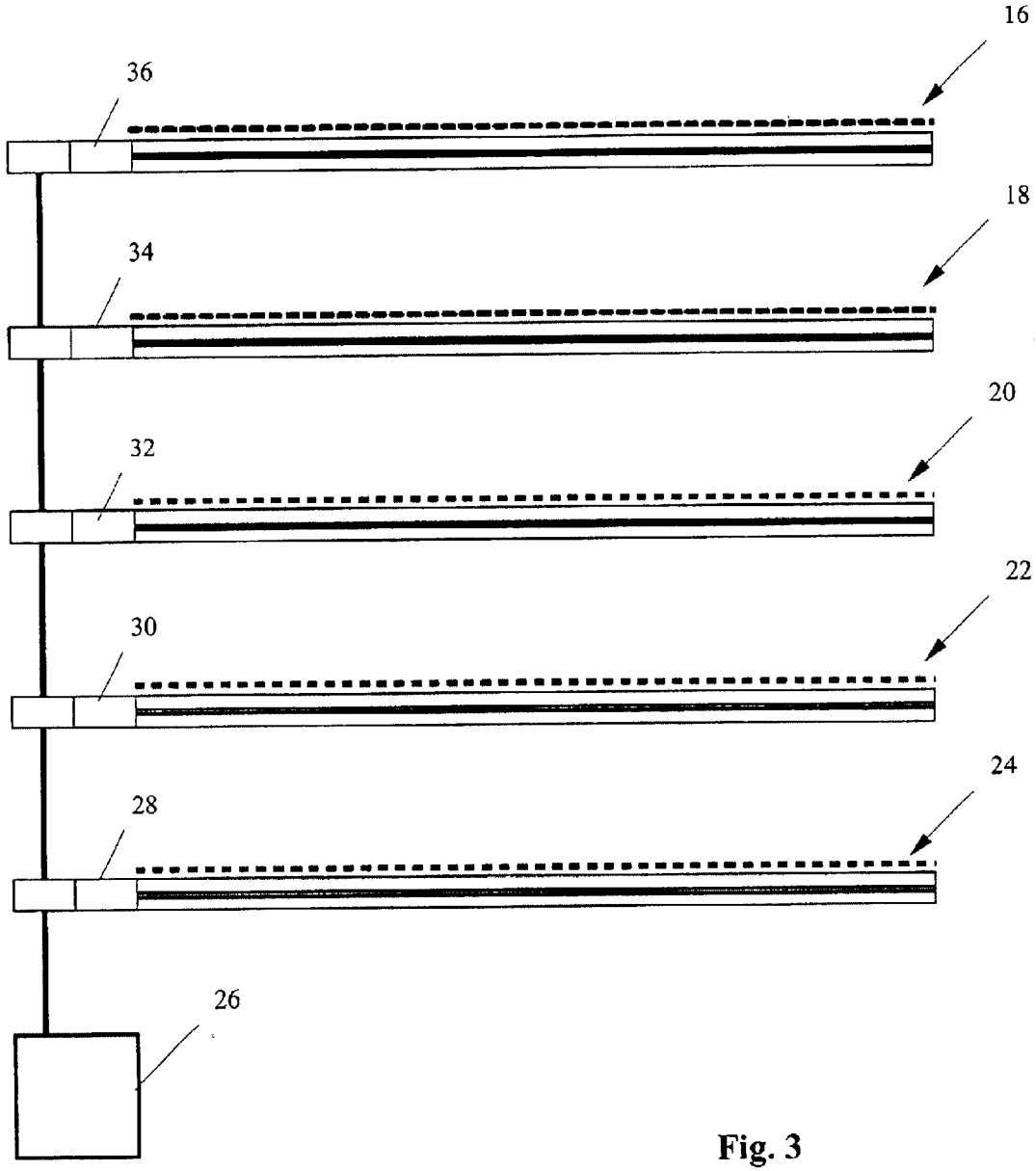
FIG. 3 shows conductor rails, each of which is connected to the coupler.

Such a bus system can serve as junction for a plurality of conductor rails. This is illustrated in FIG. 3. Here, five conductor rails 16, 18, 20, 22 and 24 are connected, each through a coupler 28, 30, 32, 34 and 36 of its own and the data bus, with the central control unit 26. There is only one coupler provided for multitude of electrical devices.

Figure 4:
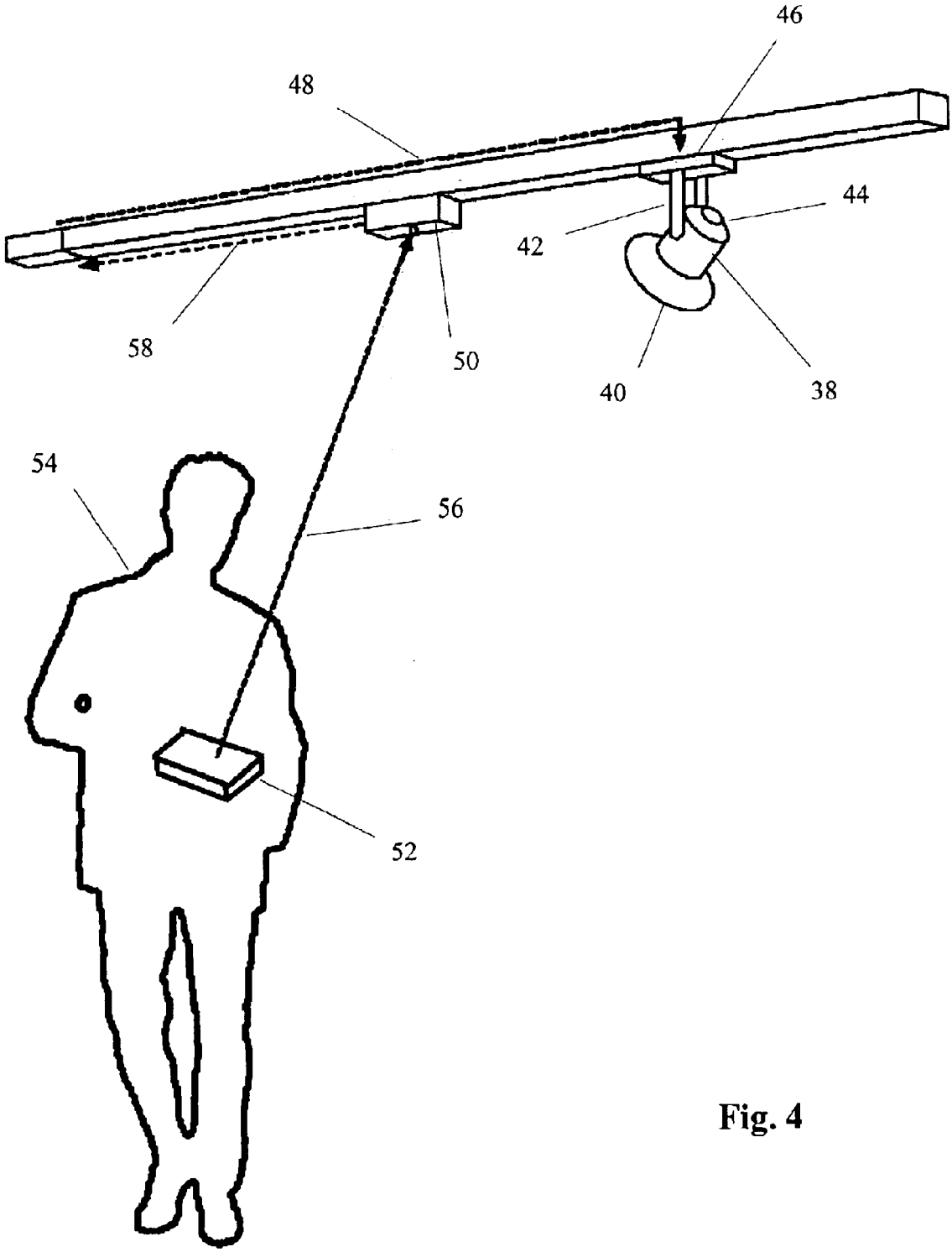
FIG. 4 shows a conductor rail with an illumination system and infrared receiver.

Different applications of the described systems are possible, dependent on the electrical device used. FIG. 4 schematically shows a simple illumination system 38. One lamp 40 is arranged movable in a holder 42. The lamp is provided with an input device 44. The illumination arrangement is clamped to the conductor rail with an adapter 46, which establishes the connection with the electric cables and the data line. The input device 44 accommodates data processing and actuator means for setting the operational state of the lamp 40. The operational state can be set by means of dimming, switching on or off, or rotation of the lamp. For complex illumination engineering applications, also optical means like color filters, lenses or mirrors can be used. Then, the operational state can be influenced by different focus, colors etc. The illumination system 38 receives the required data from the central control device or computer (not shown here). This is illustrated by an arrow.

Figure 16:
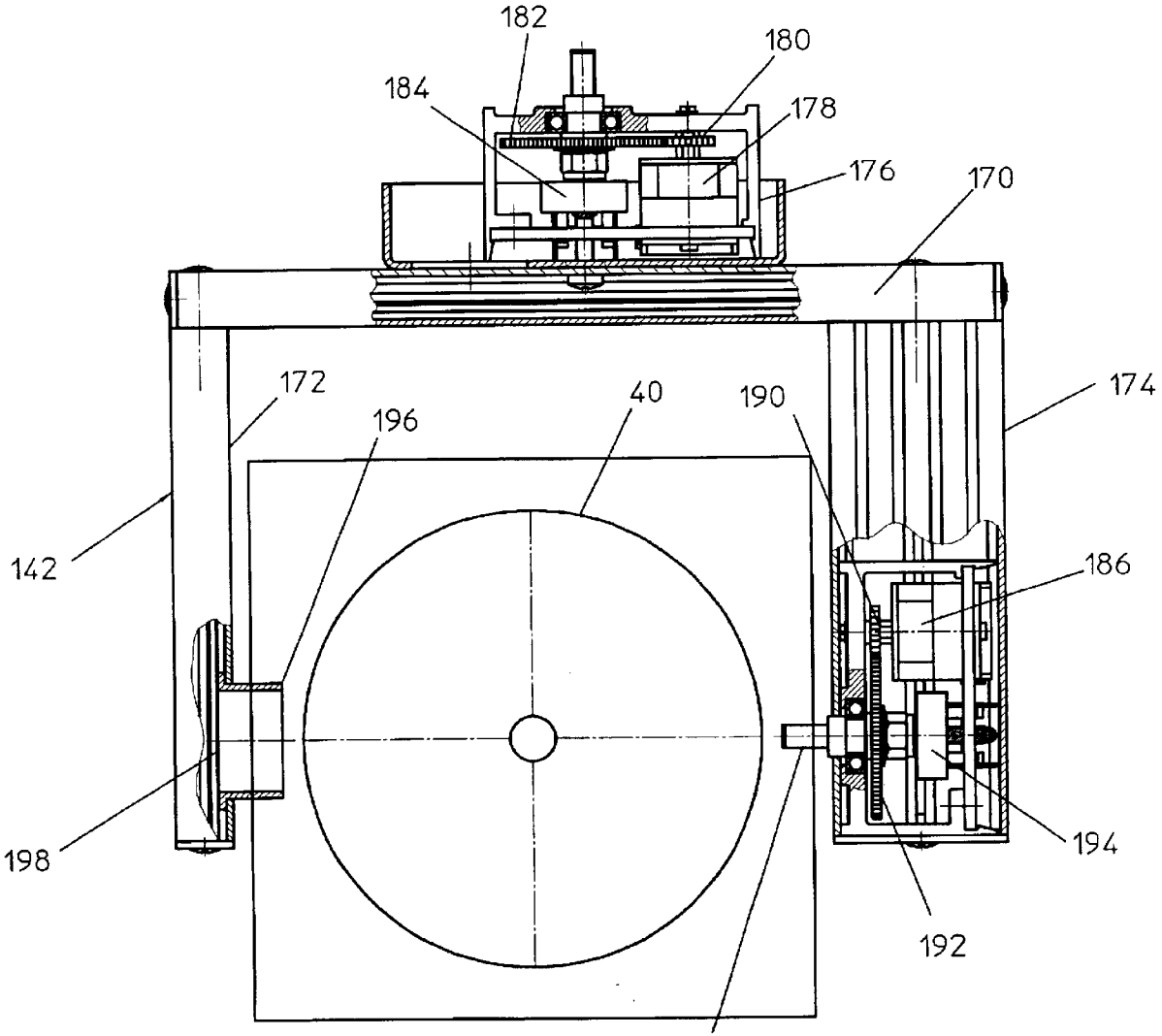
FIG. 16 illustrates a lamp assembly, which can be attached to the conductor rail and has servomotor units for adjusting the lamp in azimuth and elevation.

FIG. 16 shows a design of a lamp assembly with the holder 42. The holder 42 has a cross bar 170 with two vertical, downwardly extending legs 172 and 174. The cross bar 170 is rotatably mounted on a housing 176, which is attached to the conductor rail 10. The housing 176 contains an azimuth servomotor 178, which is in driving connection with the cross bar through gears 180 and 182 forming a step-down transmission. An angle feedback is provided by an azimuth angle sensor 184.

The leg 174 of the holder 42 carries a servomotor 186. The servomotor 186 drives a horizontal shaft 188 through gears 190 and 192. An angle feedback is provided by an elevation angle sensor 194. A lamp 40 is attached to the shaft 188.

Thereby, the lamp 40 can be rotated to assume desired elevation and azimuth orientations.

Leg 172 carries a collar 196 on its inner side surrounding a cable outlet 198. The lamp 40 is rotatably mounted, on one side, in this collar. A power cable supplying power to the lamp 40 extends from the conductor rail through the holder 42 and the cable outlet 198 to the lamp 40.

For setting the operational state of the illumination system, an infrared receiver 50 is provided on the conductor rail. The infrared receiver 50 receives data from an infrared transmitter 52, which will be operated by the user 54. The infrared transmitter 52 transmits digital data. This is a kind of remote control. Instead of a data transmission by infrared-signals, the data transmission can be effected by radio or by cable. The current values of the of the operational state for a rail section in question can be imaged on a display of the remote control 52. The operational state of the illumination system 38 can be changed by inputting new data. To this end, the infrared signals will be transmitted to the receiver 50. This is indicated by an arrow 56. The receiver 50 converts the infrared signals into a data stream, this data stream being transmitted to a central control computer. This is indicated by an arrow 58. These digital data include an address of a particular lamp or group of lamps and commands for the addressed lamp, such as "rotate through an azimuth angle of 10°". The central control computer transmits corresponding digital control signals to the addressed lamp. The data are transmitted to the input device 44. The input device provides control signals for the servomotors 178 or 186, respectively, and rotates the lamp 40 through the commanded angles. The rotation of the lamp 40 is fed back through angle sensors 184 or 194, respectively.

Figure 17:
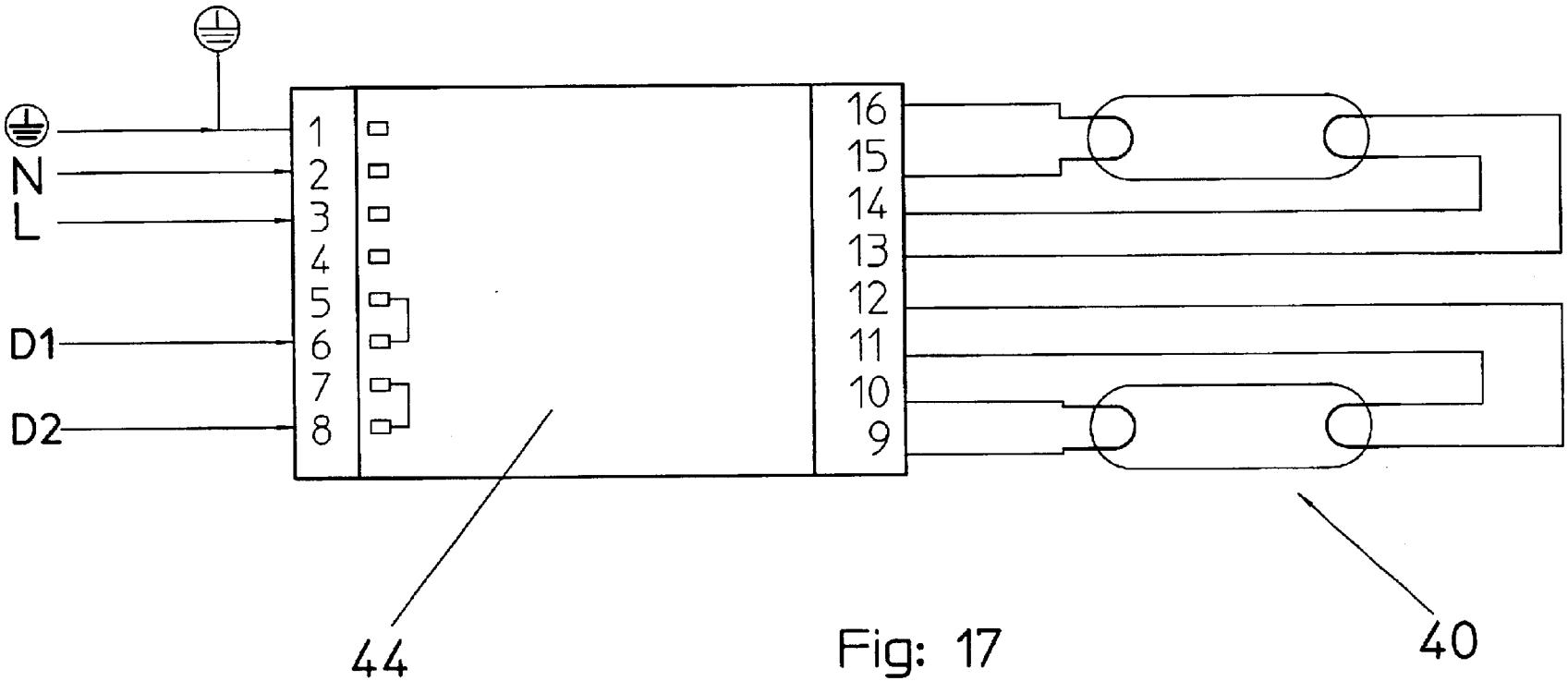
FIG. 17 illustrates an input device of a lamp, the device also having means for processing digital data to control the lamp.

An input device 44 is schematically illustrated in FIG. 17. The input device has terminals N, L and ground for the power supply, which are connected to the power conductors of the conductor rail. The input device 44 contains the conventional ballast for the lamps 200. In addition, the input device 44 contains circuitry for receiving the digital signals from the central control unit or computer 12, at inputs D1 and D2, and for converting these digital signals into control signals for controlling, for example, the servomotors 178 or 186.

Also difficultly accessible illumination systems on stages or similar environment can be set through the remote control. Further lamps can be controlled by the same receiver. Such complex illumination systems appear for example in shop windows or stages. Motors in the form of servo- or stepper motors are provided for the mechanical adjustment of the lamp. These motors can adjust the position of lamps, for example the rotation angle.

Figure 5:
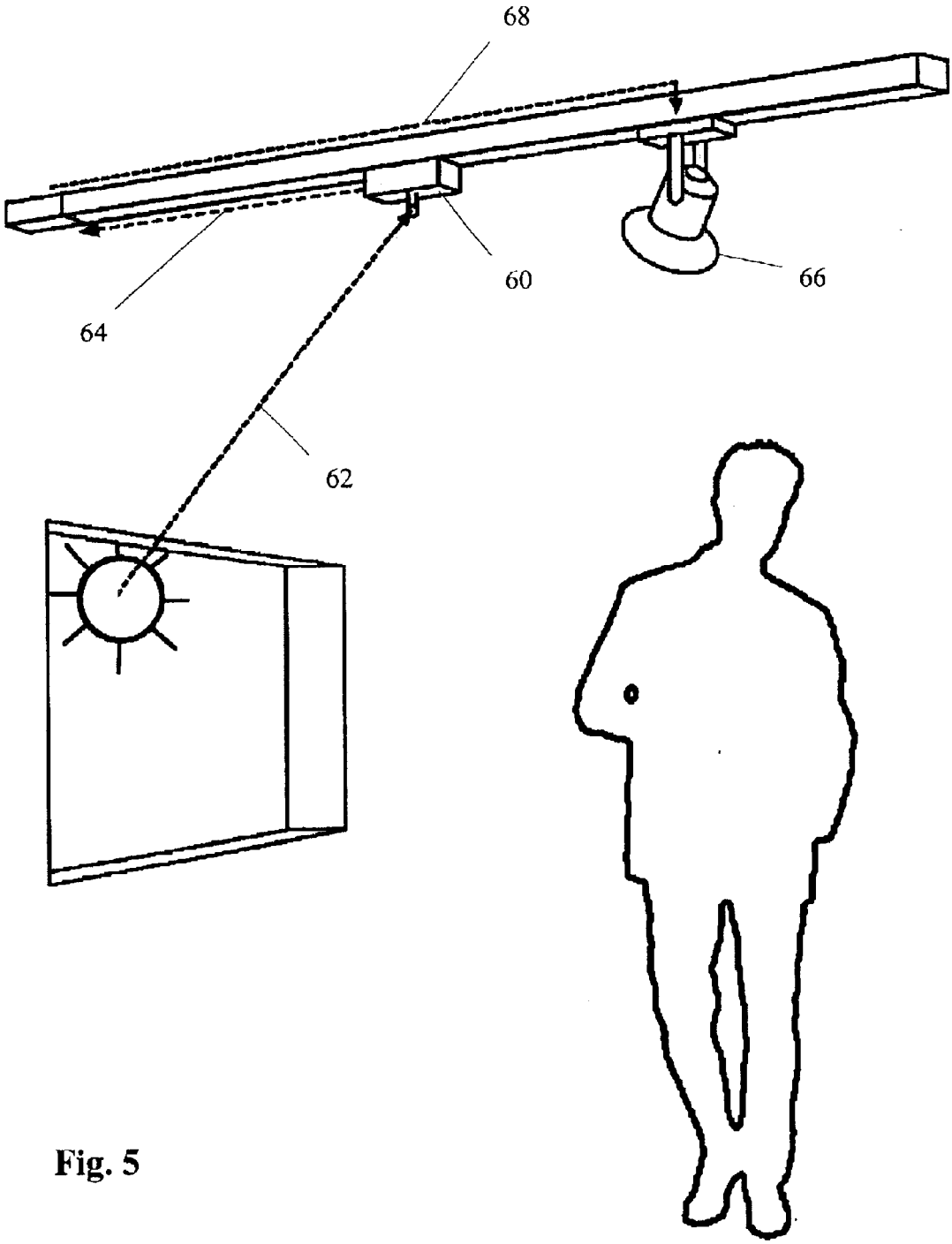
FIG. 5 shows a conductor rail with an illumination system and a daylight sensor.

A daylight sensor 60 is used in the embodiment of FIG. 5 instead of a controllable receiver. The daylight represented by an arrow 62 will be detected by a sensor 60, and the corresponding measuring value is transmitted to the central control computer. This is indicated by an arrow 64. In larger rooms, a plurality of these sensors will be used, which transfer likewise measuring data to the control computer. The data will be evaluated in the central control computer and the number of lamps to be switched on, the position and the degree of the dimmer for the connected illumination systems will be determined. The control signals will be transmitted from the central control unit, through the data line integrated in the conductor rail, to the illumination system 66. This is illustrated by an arrow 68. An intelligent building management can be realized by the use of sensors, which results in saving of energy in the illumination sector. Other sensors can be used instead of a daylight sensor. Its measuring values influence illumination systems and other systems, for example Venetian blinds. Such sensors include noise level sensors, UV-light sensors, distance measuring sensors, presence detecting sensors for detecting the presence of a person, or window-/door contacts.

Figure 18:
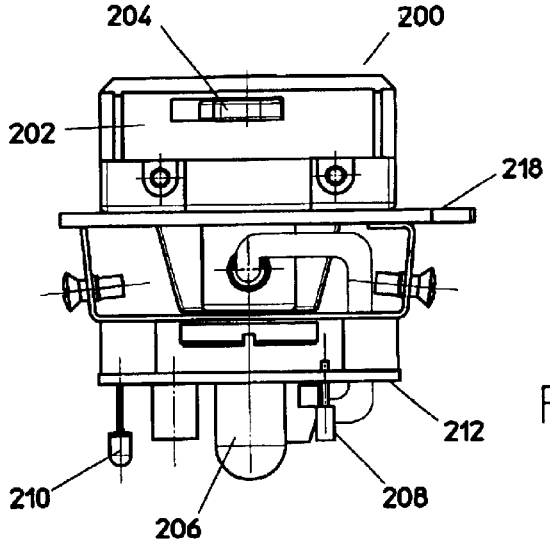
FIG. 18 is a side elevation of a sensor, which can be attached to the conductor rail, a cap of the sensor being removed.
Figure 19:
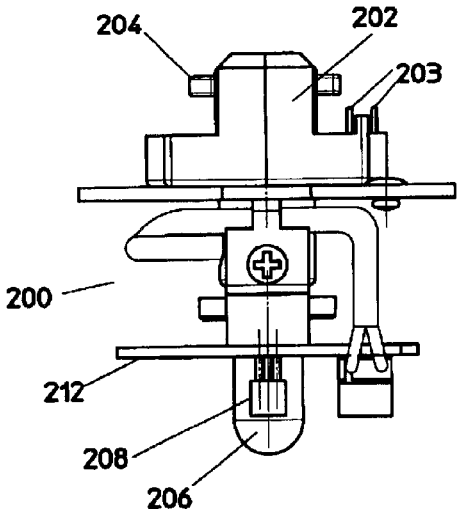
FIG. 19 is an end view of the sensor of FIG. 17.
Figure 20:
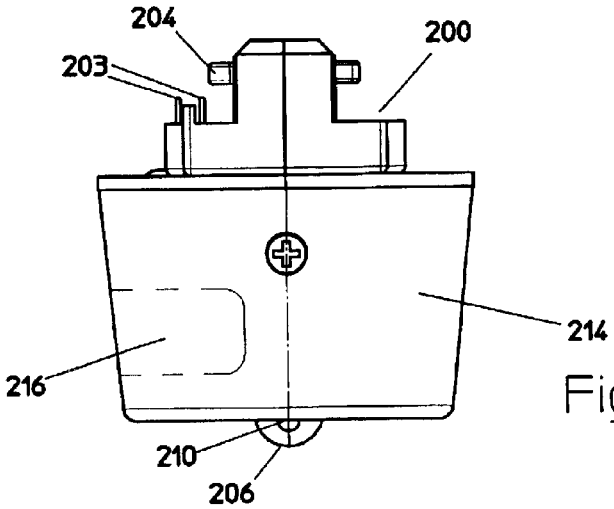
FIG. 20 shows the sensor of FIG. 18 with the cap.

FIGS. 18, 19 and 20 show a sensor unit 200 which can be used both as a "presence detector" for detecting the presence of a person or of motion, and as an illumination sensor.

In FIGS. 18 to 20, the sensor unit 200 has an elongated adapter socket 202 with locking projections 204 for attaching the sensor unit 200 to the conductor rail 10. The socket 202 also has a contact 203 for contacting the data line of the conductor rail. The sensor unit contains a presence or motion detector 206 and an illumination sensor 208. Furthermore, there is a LED 210 for indicating the operative state of the sensor unit. The sensors 206 and 208 and the LED 210 with the associated circuit components are mounted on a board 212. A cap 214 covers the board 212 and the components thereon. The cap 214 has a lateral aperture 216 for the illumination sensor 208. The board 212 with the cap 214 is rotatable about a vertical axis relative to a base 218 attached to the socket 202 to permit orientation of the illumination sensor towards a window or the like, as illustrated in FIG. 5. The presence sensor 206, with a hemispherical dome, extends through an aperture in the lower face of the cap 214. Also the LED 210 extends through an aperture in the lower face of the cap 214.

Figure 6:
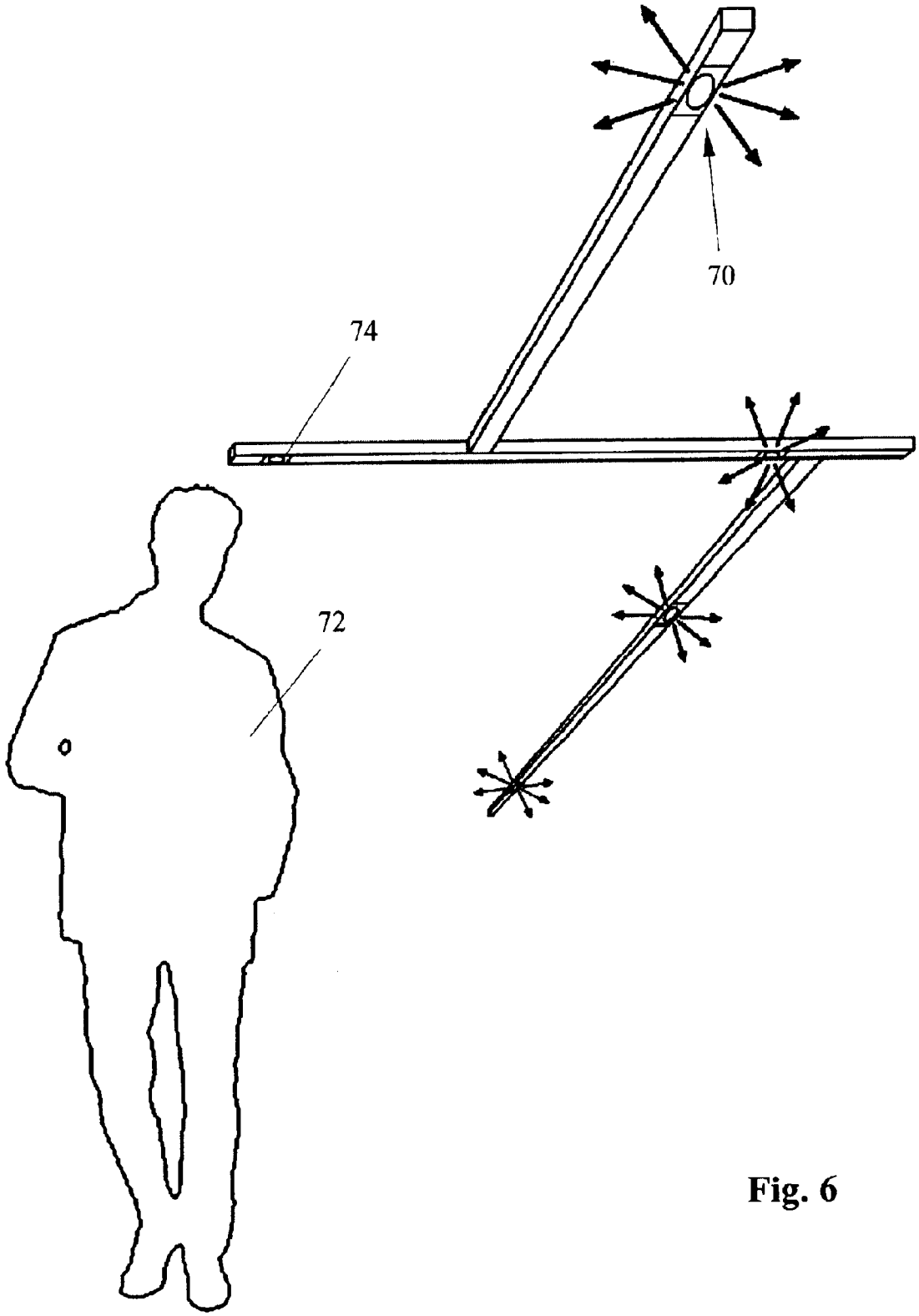
FIG. 6 shows an illumination system with a conductor rail in the form of a simple guiding system.

An illumination system in the form of a simple guiding system is illustrated FIG. 6. After the guiding system has been activated by a sensor or receiver, the selected lamps 70 will be activated. Other lamps 74, which are not located along the user's path, are switched off. The person 72, who is not familiar with the location, needs only follow the lamps, one after another, to reach his destination. The lamps can be activated one after another to indicate the way, in conjunction with presence sensors for detecting the presence of a person or with motion detectors. The lamps can also be activated simultaneously. The lamps may also be designed as arrows or may project information about the way to be followed to the ground.

Figure 7:
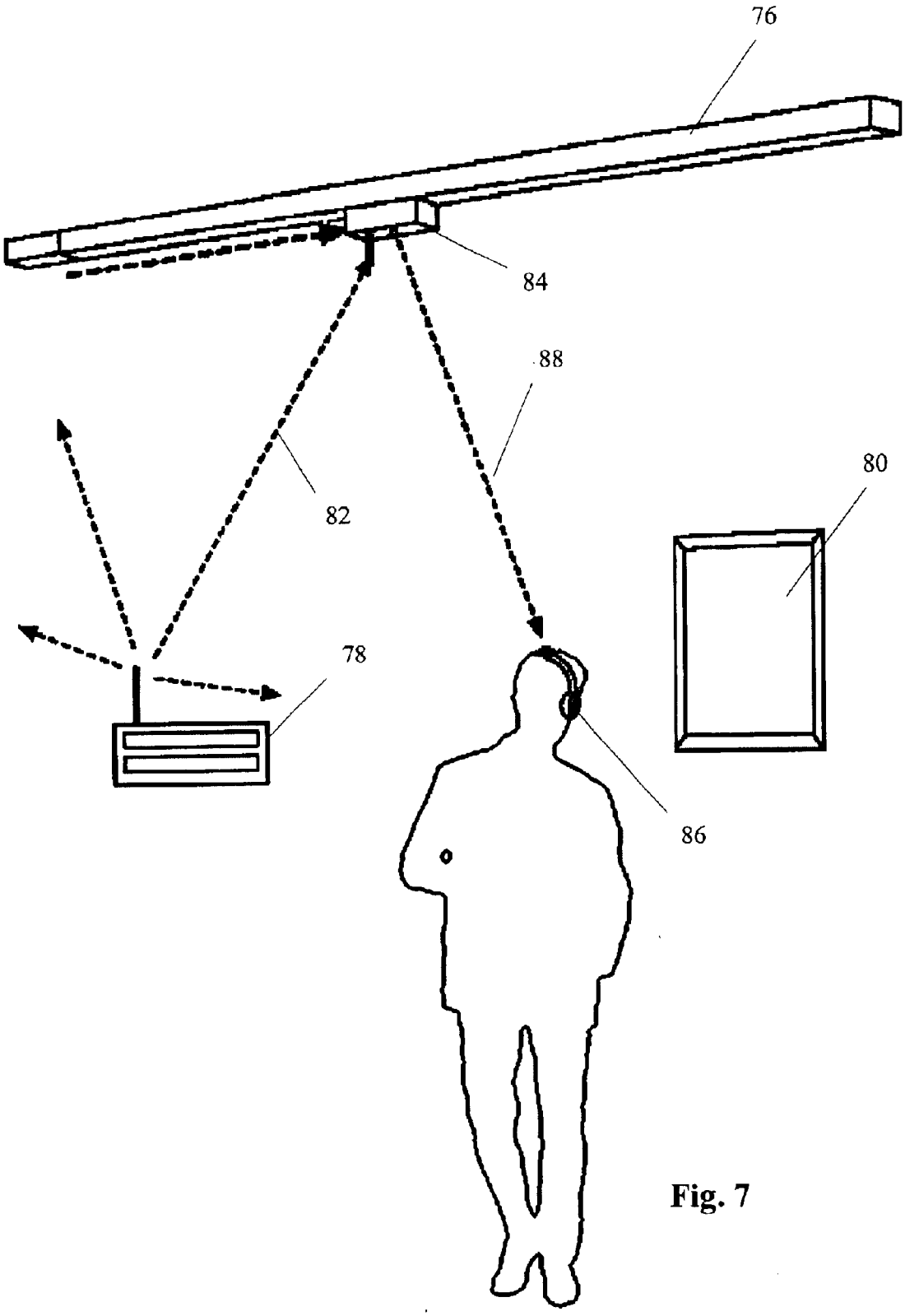
FIG. 7 illustrates the use of a conductor rail system with an infrared transmitter in a museum.

The use of a conductor rail system 76 in a museum or in a exhibition is shown in FIG. 7. A local radio transmitter 78 distributes the stored audio information for each exhibit 80 to an associated channel. This is indicated by arrows 82. A receiver unit 84 associated with an exhibit 80 is located on the conductor rail in the section near this exhibit 80. The receiver unit 84 receives the signals 82 on the channel associated with that exhibit 80. The appropriate radio channel will be selected through the data line of the conductor rail 76 and transmitted as audio-modulated infrared signal to all headphones 86, which are in the zone. Also an infrared transmission can be used instead of a radio transmission. This is illustrated as an arrow 88. By use of the radio transmitter no large amounts of data have to transmitted to the receiver, but only the information through the radio channel.

Figure 8:
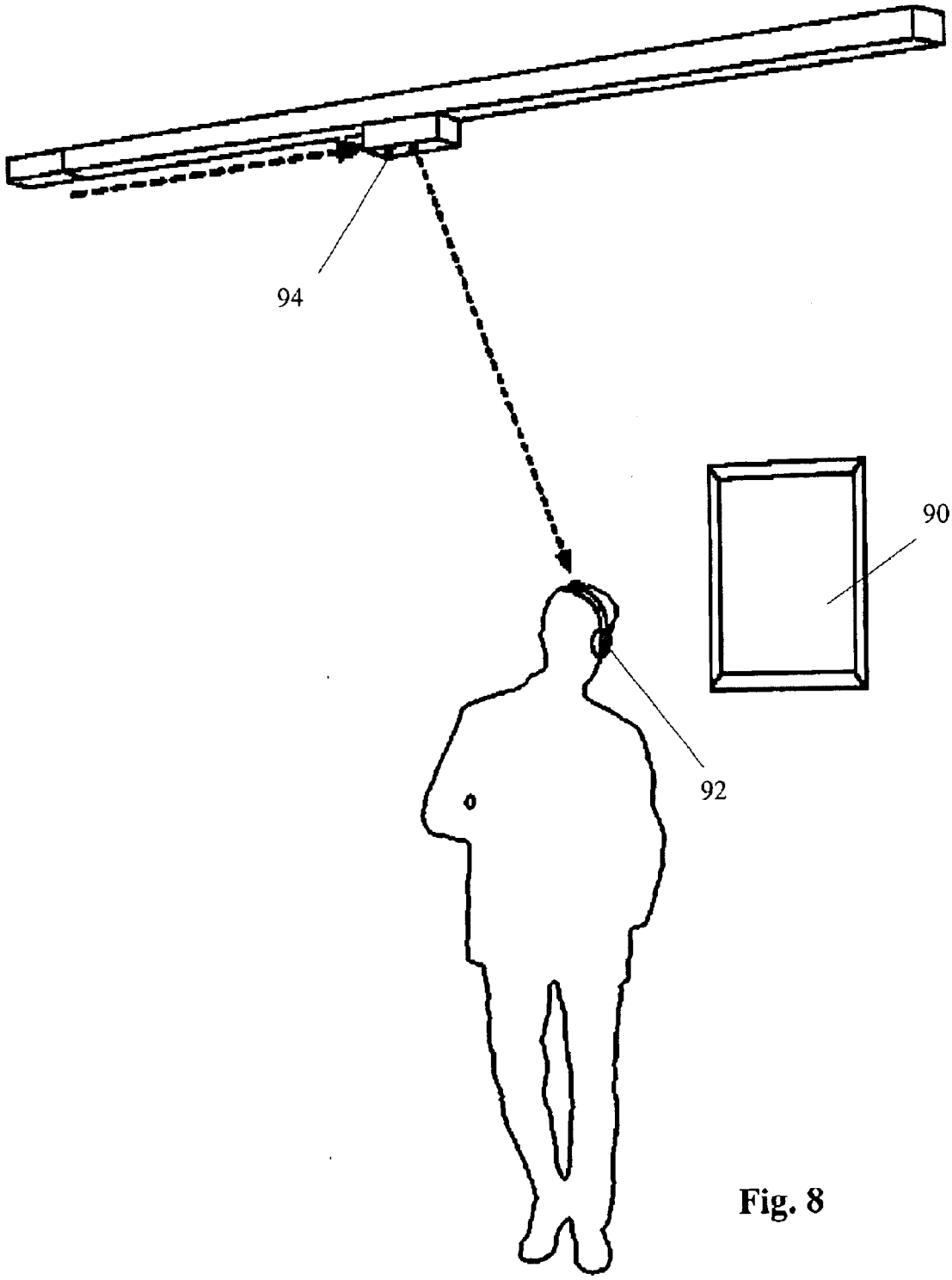
FIG. 8 illustrates the use of a conductor rail system in a museum, where the information to be given to a visitor is already stored in the visitor's receiver device.

A different solution to convey information in a museum is illustrated in FIG. 8. In this solution, the information, that means the audio information of different exhibits 90 of a museum, are completely contained in the receiver 92. The aimed, locally bound calling up of information happens through an infrared transmitter 94 from the conductor rail. Also here, the transmission can be effected by radio transmission instead infrared transmission. The selection of information is defined through the data transfer of the conductor rail. This principle can very well be used also in the guiding system.

Figure 9:
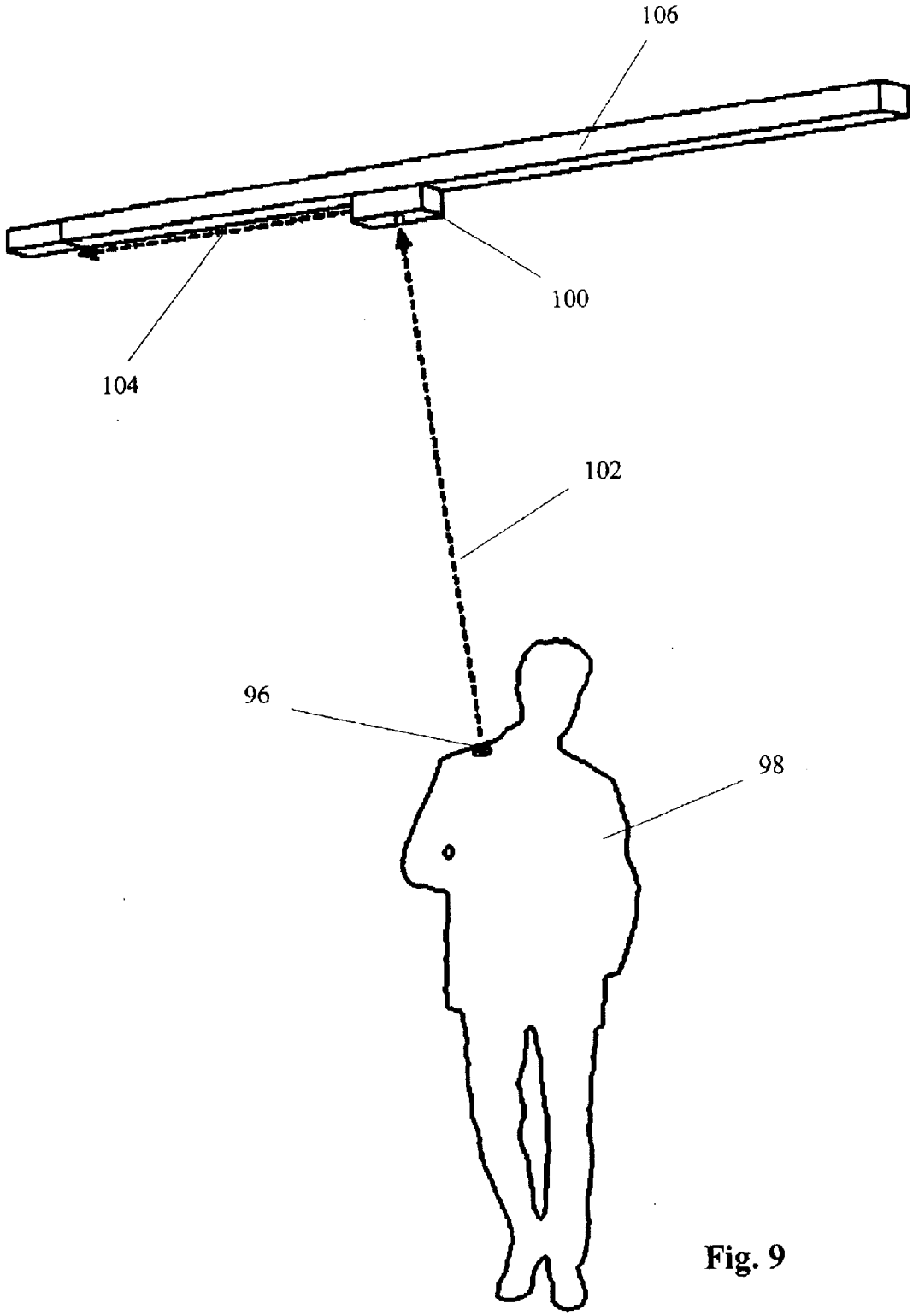
FIG. 9 shows the use of a conductor rail system for localizing persons.

In FIG. 9 an infrared-transmitter 96 is mounted on the shoulder of a person 98. The transmitter 98 emits continuously a person-specific code. This code can be detected by infrared receivers 100 on significant locations in a complex building. This is illustrated by an arrow 102. The data will be transferred through the conductor rail 106 to the central control unit. .This is illustrated by an arrow 104. The data contain information about the current position of a person, which can be detected and, if required, may be recorded by a central office. The central office is continuously informed about the position and length of stay of all interesting persons in the house. Also materials, like documents or the like can be localized. The localisation system is especially suitable for the use in hospitals, senior residences etc. where doctors or nurses have to be found quickly.

Figure 10:
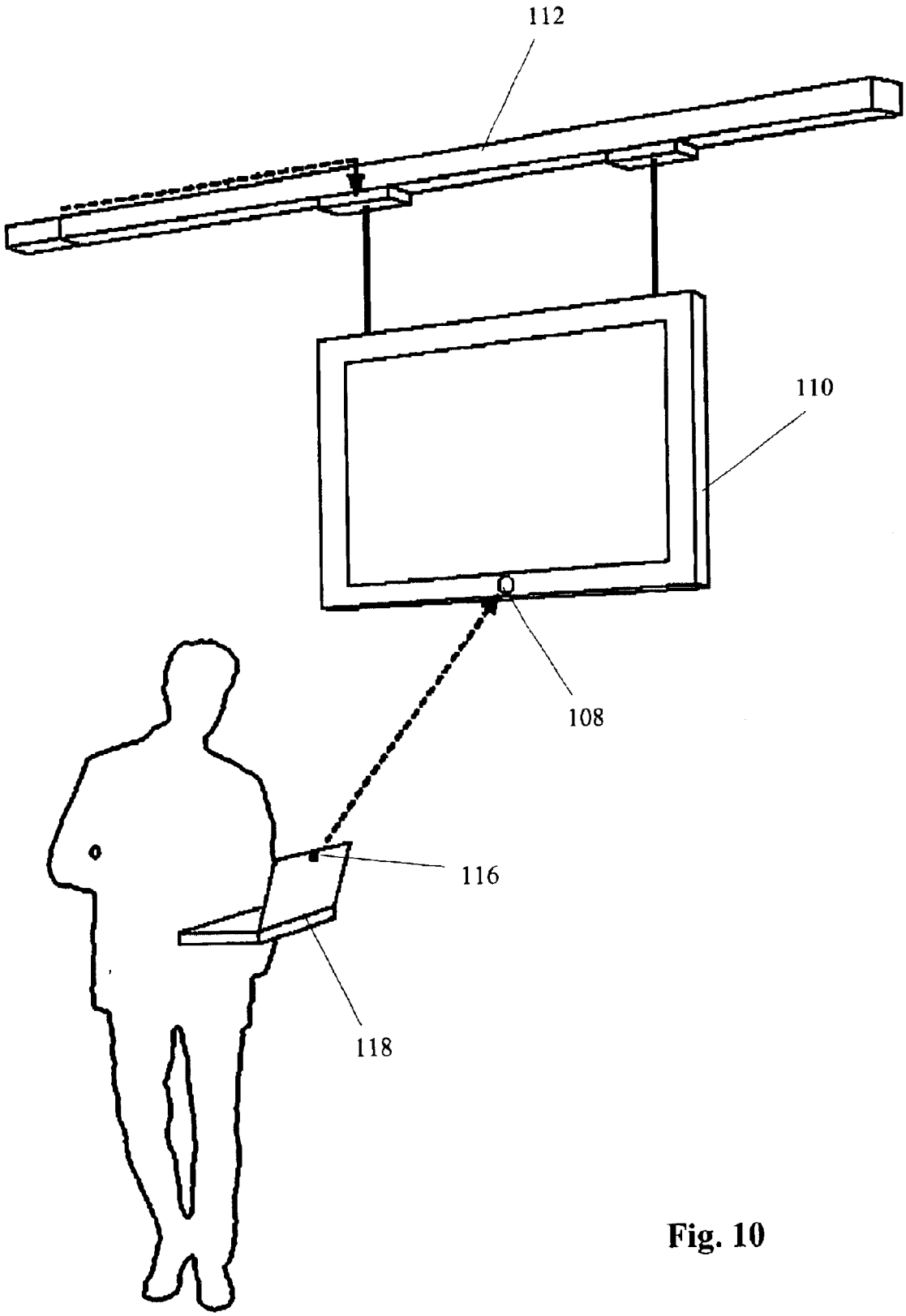
FIG. 10 shows a conductor rail system with a receiver, which receives information to be depicted on a display.

The use of a further device in form of an infrared-receiver 108 with a display 110 is illustrated in FIG. 10. The display 110 (or a suitable monitor) serves for the playback of text and image information, requiring high storage capacity and high transmission rate. Hence transmission through the data line 112 of the conductor rail system is not appropriate. Rather will the data be transmitted by an infrared transmitter 108, which is coupled to a memory 118, to the infrared receiver 108 of the display 110, while the control is effected through the data line 112 of the conductor rail. This includes the selection, modification and the setting of the course of picture sequences. This includes the start and the end, loudness, brightness, length of sequences and the like. This is illustrated as an arrow 114. Also the settings will be made based on environmental information, received from sensors (not illustrated) or receivers.

Figure 11:
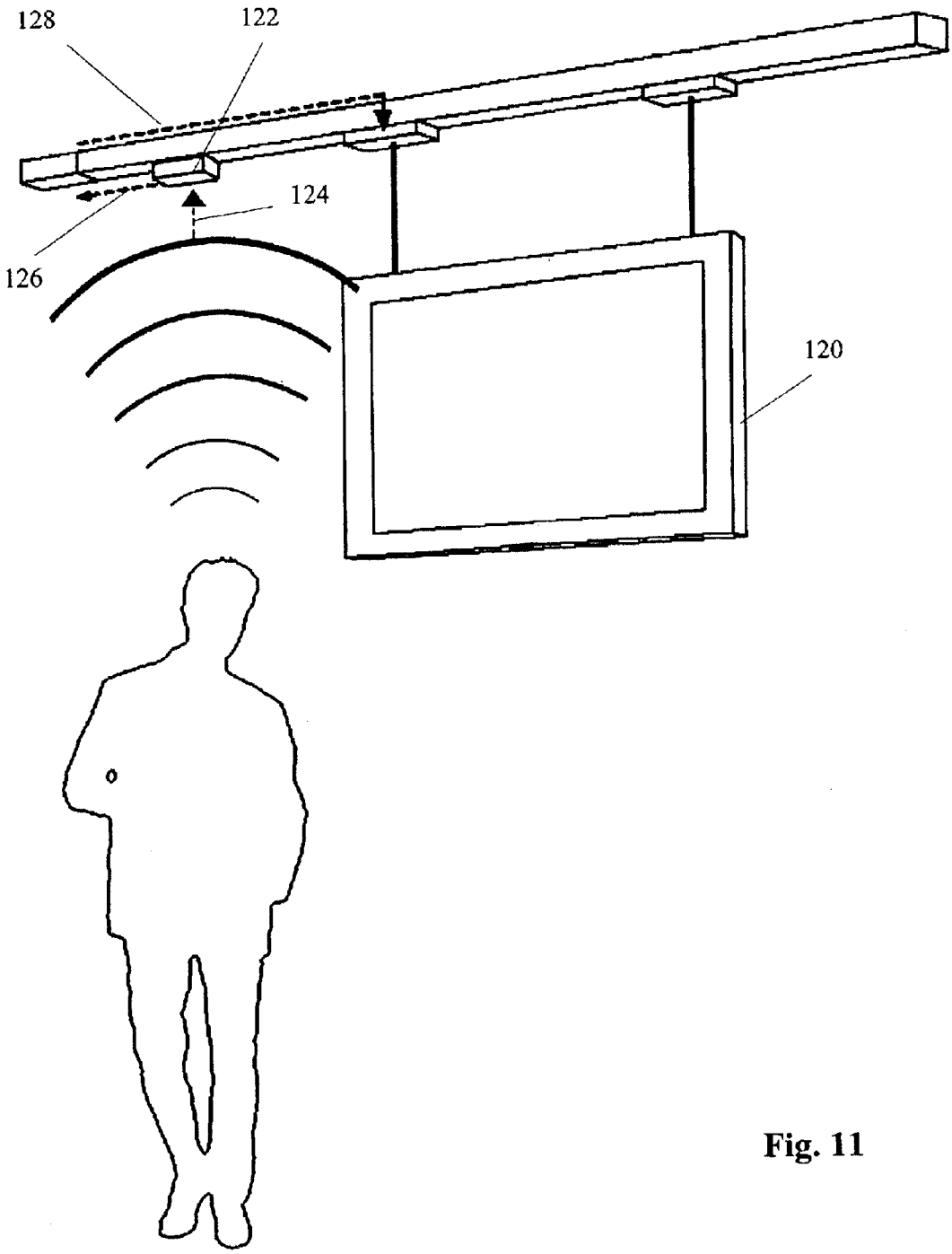
FIG. 11 shows a conductor rail system with a display, the settings for operation of which are controlled depending on signals from a sensor.

The information can be contained in a memory, which is integrated in a display 120. This case is illustrated in FIG. 11. A sensor 122 detects the environmental information, e.g. the noise level. This is illustrated as an arrow 124. The information will be transferred to the central control unit. This is illustrated as an arrow 126. The control unit supplies commands for setting of the noise level to the display 120. This is illustrated as an arrow 128. In the same way the brightness can be set and regulated depending on the signal from a brightness sensor. The system from FIG. 11 is especially suitable for the use as information board for information text, departure times displays in airport terminals, and also for interposing advertisements. Systems for presence detection or counting systems can be used to provide information about the number of detected persons. This is, in particular, interesting for the advertisement business.

Figure 12:
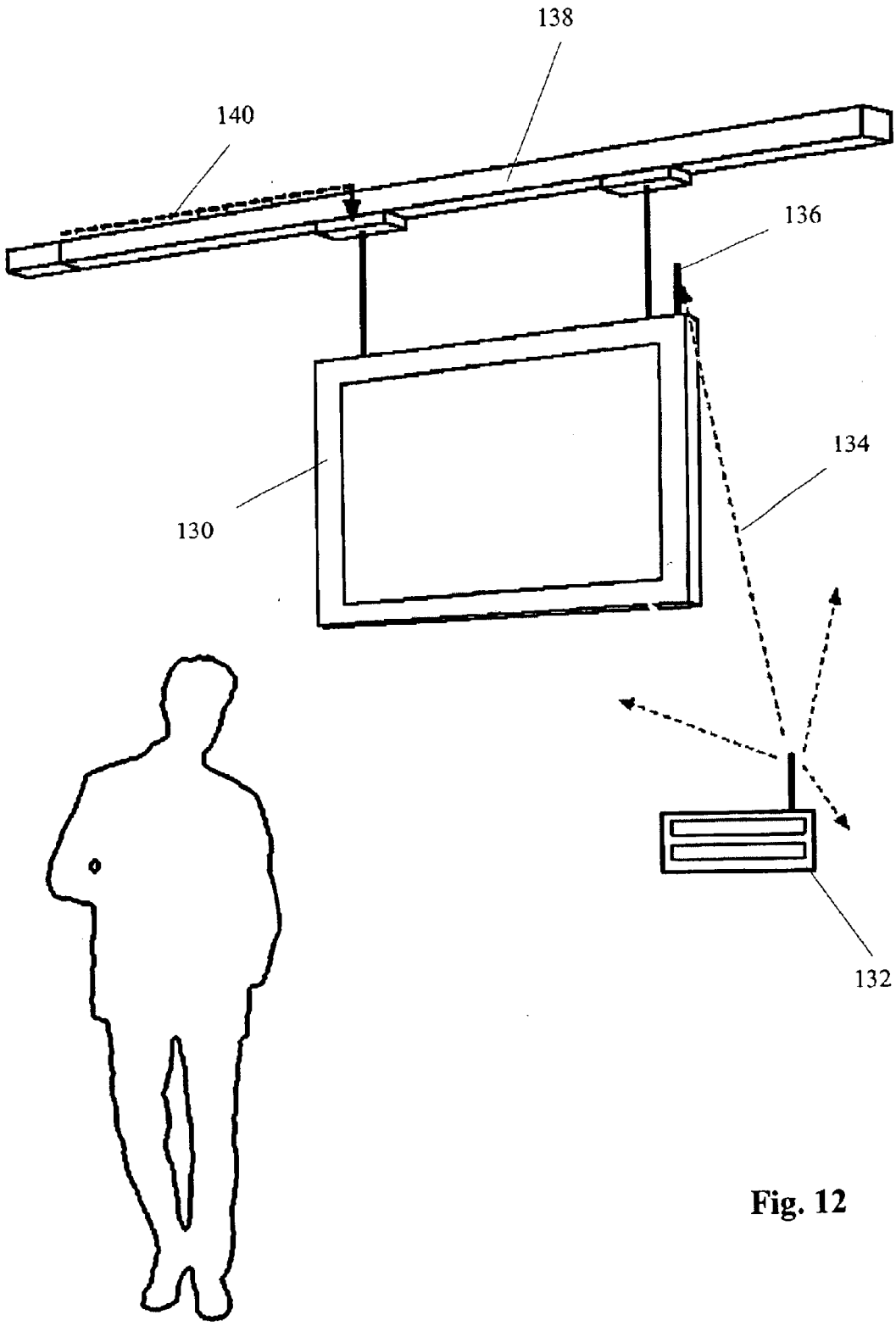
FIG. 12 shows a conductor rail system, where a display receives information from the transmitter.

A display is also illustrated in FIG. 12. Here, the data will be transferred through an external video recorder 132 to the receiver 136. This is illustrated as an arrow 134. In this solution a plurality of displays can receive video information. Beside the power supply also a selection and control of the displays can be made through control commands from the central control unit over the conductor rail 138. This is illustrated as an arrow 140. Also here, the control of the displays can be effected on the base of information obtained by sensors.

Figure 13:
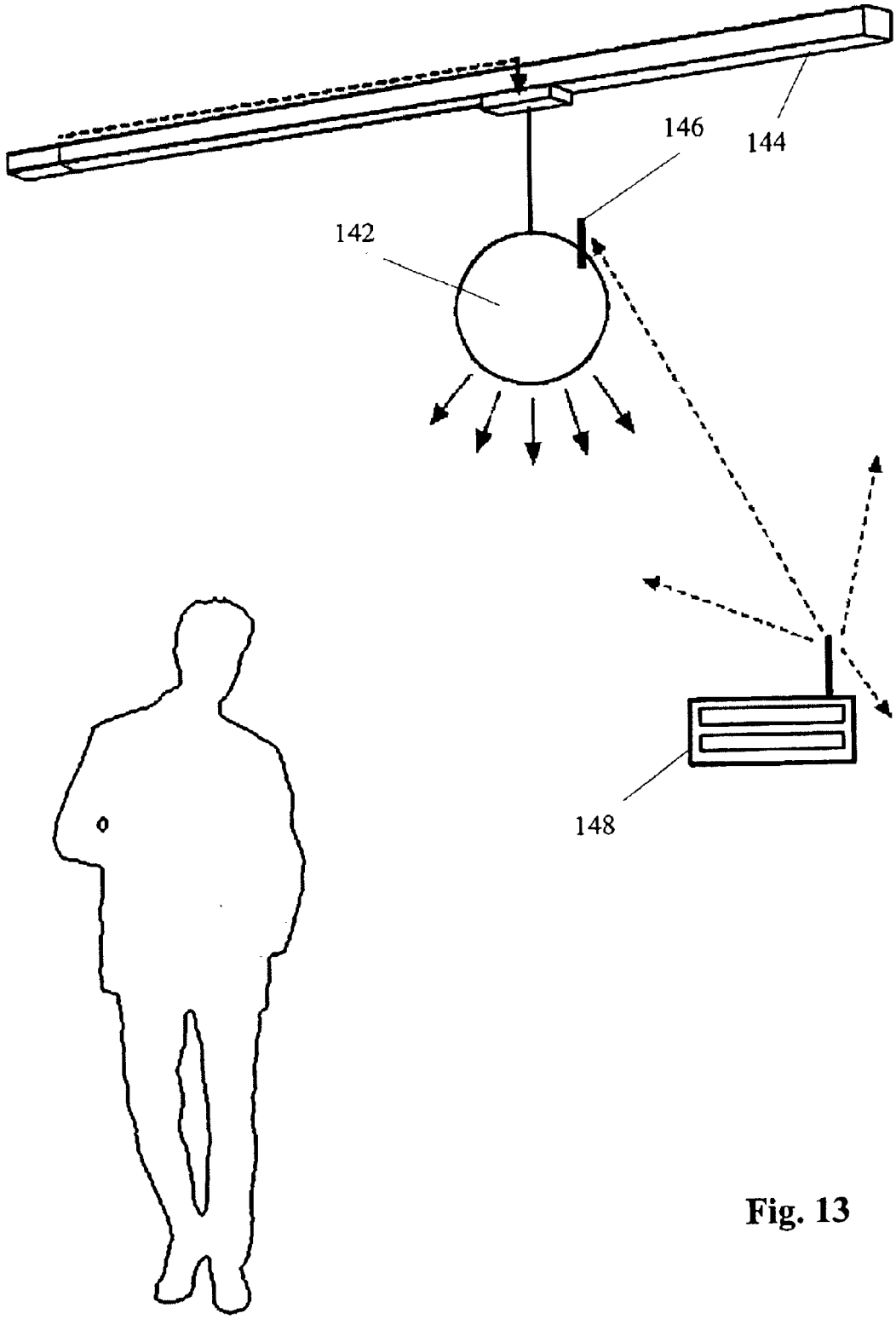
FIG. 13 shows a conductor rail system, where a receiver is connected to a loudspeaker, which plays back audio information.

FIG. 13 illustrates an application, where a sound system 142 is connected to the conductor rail 144. In the illustration of, the FIG. 13 sound system receives information from an infrared receiver 146. The infrared receiver 146 receives data from the infrared transmitter 148. On the other hand, loudness, type and extent of the emitted audio information can be controlled by a central control unit. In conjunction with a system for localization, described, for example, with reference to FIG. 9, a locally restricted call to a looked-for person can be made. Thereby, the selected sound system 142 will be switched automatically on the radio channel of the call, while the remaining installation is not affected. The loudness of the sound system can also be adjusted depending on the signals from a noise level sensor or a presence detection sensor.

The above described applications require electrical devices, which can be attached to a conductor rail system. The electrical devices can be combined and interchanged. Even a person of limited skill can add or remove the devices.

Figure 14:
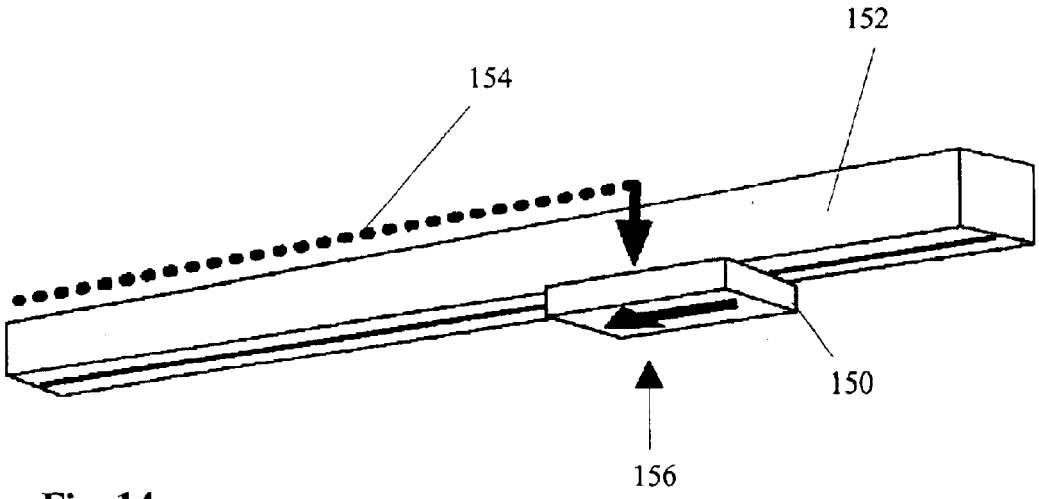
FIG. 14 shows a signal lamp connected to a conductor rail.

Further devices can be attached and electrically connected to the conductor rail beside the described sensors, lamps, displays and sound systems. Such a device may be a signal lamp. This is illustrated in FIG. 14. The signal lamp 150 receives the data from the data line of the conductor rail 152. The data will be converted by the signal lamp (without feedback). This is illustrated as an arrow 154. As a shining area 156, which consists of a multitude of light-emitting diodes, it can shine or flash in any colors, depending of the received data. Furthermore a suitable symbol, for example an arrow can be formed from the light dots. This arrow points, for example, in the direction, which the visitors have to follow. By combination of arrow, digit, letter or color, alternating shining, a plurality of persons can be guided specificly. The data necessary to guide the visitors originate from a database. The database can be activated on a computer device by the staff of the reception or the visitor itself. This will be done by selecting the desired destination. To reach the selected destination, the letter or the digit, which the person has to follow, will be displayed on the monitor.

Figure 15:
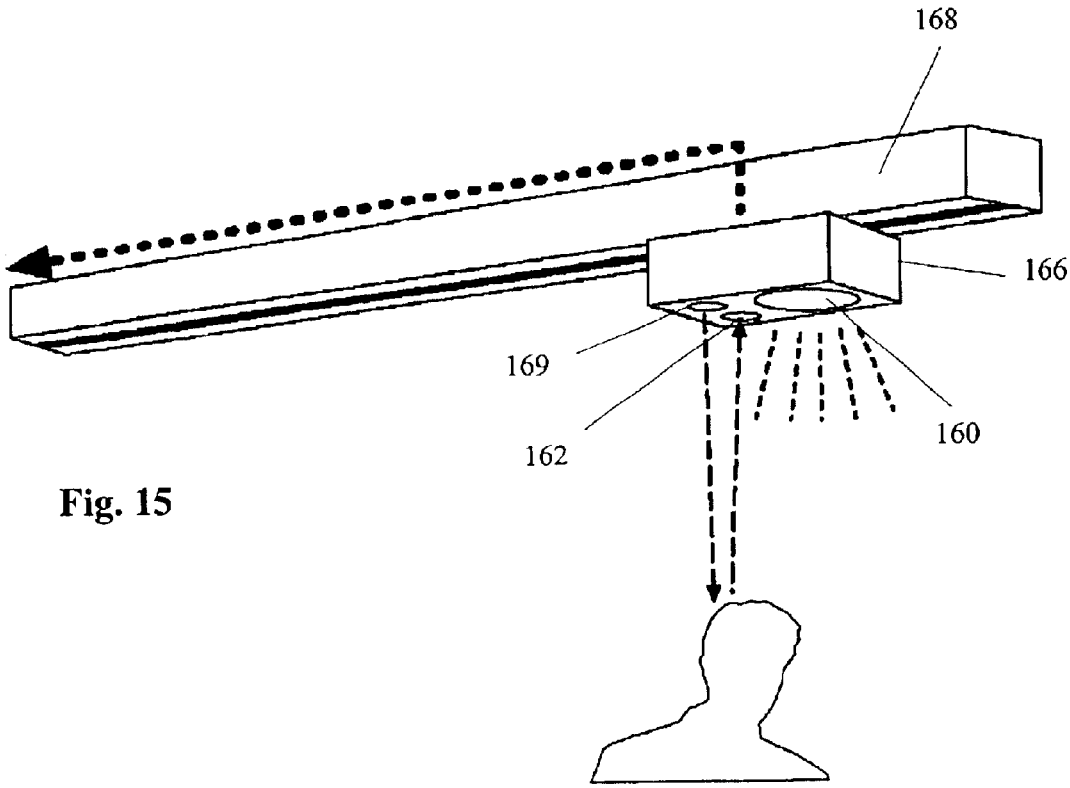
FIG. 15 shows a guide module for persons on acoustic basis.

Also a persons guiding module or a persons orientation module on acoustic basis is provided analogue to the personal guiding module on a visual basis. This is especially suitable for blind- or visually handicapped people. Such a device 160 is illustrated in FIG. 15. The device 160 consists of a combination of distance or motion detectors 162 with a loudspeaker 166. The device is located on the conductor rail 168 on special places or specially marked places in a building. If a person or motion is detected, a short information about the location can be heard, gentle but loud enough for the vicinity. The device is also applicable in the field of shop building. Customers will then be referred, dependent on the specific location, to the products in the near field. Highlighting illumination for special products or shelves can be activated together with a sensor for example a distance-sensor.

All devices have a safety module. The safety module is connectable to the input device or is integrated in the input device. It consists mainly of a fuse. With the installation of a safety module a short circuit between the power supply and the data line should be prevented in the case of defects in a device. The data line can be freely accessible and does not require protection as only small currents flow therethrough. The safety module is formed as adapter and can be connected through a simple plug-in connector.

We claim:

1. An electrical supply and control system for supplying electrical energy to a lamp arrangement and for remote-controlling said lamp arrangement, comprising:

at least one profiled conductor rail with power conductor means and control line means extending along said conductor rail, means for releasably attaching said lamp arrangement to said conductor rail and for, thereby, electrically connecting said power conductor means and said control line means to said lamp arrangement, sensor means independent of said lamp arrangement and having adapter means for releasably attaching said sensor means at any location along said conductor rail mechanically to said profiled conductor rail and for contacting said sensor means with said control line means, and central control means connected to said control line means for receiving, through said control line means, signals from said sensor means and for transmitting, through said control line means, control signals for controlling at least one lamp of said, said sensor means transmitting sensor signals exclusively to said central control means, said lamp arrangement being controlled exclusively by said central control means in such a manner that each lamp of said arrangement being individually addressable by said central control means.

2. A system as claimed in claim 1, wherein said central control means are contained in a control unit and comprise adapter means for attaching said control unit to said profiled conductor rail and for, thereby, electrically connecting said power conductor means and said control line means to said central control means.

3. A system as claimed in claim 1, wherein said sensor means comprise means for detecting the presence of a person, said control signals from said central control means activating at least one of said lamps, when said sensor means detect the presence of a person, and de-activating said lamp, when said sensor means no longer detect the presence of a person.

4. A system as claimed in claim 1, wherein said lamp arrangement comprises a movable element and actuator means, coupled to said movable element and controlled by said control signals from said central control means to adjust the position or orientation of said movable element.

5. A system as claimed in claim 1, wherein said lamp arrangement comprises means for varying a characteristic of said lamp arrangement, said varying means being controlled by said control signal from said central control means due to said control means receiving said sensor signal from said sensor means to vary said characteristic of said lamp arrangement depending on said sensor signal.

6. A system as claimed in claim 1, wherein said lamp arrangement comprises means for varying the color of said lamps, said varying means being controlled by said control signal from said central control means due to said control means receiving said sensor signal from said sensor means to vary the color of said lame arrangement depending on said sensor signal.

7. An electrical supply and control system for supplying electrical energy to an electrical device arrangement and for remote-controlling said electrical device arrangement, comprising:

at least one profiled conductor rail with power conductor means and control line means extending along said conductor rail, means for releasably attaching at least one electrical device of said electrical device arrangement to said conductor rail and for electrically connecting said power conductor means and said control line means to said device, sensor means separate from other electrical devices and having adapter means for releasably attaching said sensor means at any location along said conductor rail mechanically to said profiled conductor rail and for connecting said sensor means with said control line means, and central control means connected to said control line means for receiving, through said control line means, signals from said electrical device arrangement and for transmitting, through said control line means, control signal for controlling said at least one electrical device of said electrical device arrangement, said sensor means transmitting sensor signals exclusively to said central control means, said electrical device arrangement being controlled exclusively by said central control means, each said electrical device of said electrical device arrangement being individually addressable by said central control means, wherein said electrical device arrangement further comprises replay system means for replaying acoustic signals in continuous operation, said replay system means and means for triggering said replay system means, when receiving said control signal from said central control means due to said central control means, are receiving said sensor signal from said sensor means.

8. An electrical supply and control system for supplying electrical energy to an electrical device arrangement and for remote-controlling said electrical device arrangement, comprising:

at least one profiled conductor rail with power conductor means and control line means extending along said conductor rail, means for releasably attaching at least one electrical device of said electrical device arrangement to said conductor rail and for electrically connecting said power conductor means and said control line means to said device, sensor means separate from other electrical devices and having adapter means for releasably attaching said sensor means at any location along said conductor rail mechanically to said profiled connector rail and for connecting said sensor means with said control line means, and central control means connected to said control line means for receiving, through said control line means, signals from said electrical device arrangement and for transmitting, through said control line means, control signal for controlling said at least one electrical device of said electrical device arrangement, said sensor means transmitting sensor signals exclusively to said central control means, said electrical device arrangement being controlled exclusively by said central control means, each said electrical device of said electrical device arrangement being individually addressable by said central control means, wherein said electrical device arrangement further comprises display means for displaying video sequences or pictures and means for triggering said display means, when receiving said control signal from said central control means due to said central control means, are receiving said sensor signal from said sensor means.

9. An electrical supply and control system for supplying electrical energy to an electrical device arrangement and for remote-controlling said electrical device arrangement, comprising:

at least one profiled conductor rail with power conductor means and control line means extending along said conductor rail, means for releasably attaching at least one electrical device of said electrical device arrangement to said conductor rail and for electrically connecting said power conductor means and said control line means to said device, sensor means separate from other electrical devices and having adapter means for releasably attaching said sensor means at any location along said conductor rail mechanically to said profiled connector rail and for connecting said sensor means with said control line means, and central control means connected to said control line means for receiving, through said control line means, signals from said electrical device arrangement and for transmitting, through said control line means, control signal for controlling said at least one electrical device of said electrical device arrangement, said sensor means transmitting sensor signals exclusively to said central control means, said electrical device arrangement being controlled exclusively by said central control means, each said electrical device of said electrical device arrangement being individually addressable by said central control means, wherein said electrical device arrangement, further comprises direction display means for displaying a direction and means for controlling said display means to indicate the direction, when receiving said control signal from said central control means due to said control means, are receiving said sensor signal from said sensor means.

10. An electrical supply and control system for supplying electrical energy to an electrical device arrangement and for remote-controlling said electrical device arrangement, comprising:

at least one profiled conductor rail with power conductor means and control line means extending along said conductor rail, means for releasably attaching at least one electrical device of said electrical device arrangement to said conductor rail and for electrically connecting said power conductor means and said control line means to said device, sensor means separate from other electrical devices and having adapter means for releasably attaching said sensor means at any location along said conductor rail mechanically to said profiled conductor rail and for connecting said sensor means with said control line means, and central control means connected to said control line means for receiving, through said control line means, signals from said electrical device arrangement and for transmitting, through said control line means, control signal for controlling said at least one electrical device of said electrical device arrangement, said sensor means transmitting sensor signals exclusively to said central control means, said electrical device arrangement being controlled exclusively by said central control means, each said electrical device of said electrical device arrangement being individually addressable by said central control means, wherein said electrical device arrangement further comprises alarm or emergency call means and means for triggering said alarm or emergency call means, when receiving said control signal from said central control system means due to said central control means, are receiving said sensor signal from said sensor means.

* * * * *